US009668565B2

(12) United States Patent
Schreiber et al.

(10) Patent No.: US 9,668,565 B2
(45) Date of Patent: Jun. 6, 2017

(54) APPLICATOR FOR A COSMETIC PRODUCT, IN PARTICULAR MASCARA, AND METHOD OF MANUFACTURING SUCH AN APPLICATOR

(71) Applicant: ALBEA SERVICES, Gennevilliers (FR)

(72) Inventors: Camille Schreiber, Paris (FR); Anne Rutigliano, Maisons-Laffitte (FR); Patrick Lhoyer, Mouy (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/666,598

(22) Filed: Mar. 24, 2015

(65) Prior Publication Data

US 2015/0272300 A1 Oct. 1, 2015

(30) Foreign Application Priority Data

Mar. 25, 2014 (FR) ..... 14 52505

(51) Int. Cl.
*A46B 9/02* (2006.01)
*A45D 40/26* (2006.01)
(Continued)

(52) U.S. Cl.
CPC ..... *A45D 40/265* (2013.01); *A46B 3/18* (2013.01); *A46B 9/021* (2013.01); *A46B 9/028* (2013.01);
(Continued)

(58) Field of Classification Search
CPC ..... A46B 9/026; A46B 9/028
(Continued)

(56) References Cited

U.S. PATENT DOCUMENTS

2002/0020426 A1 2/2002 Gueret
2002/0139385 A1 10/2002 Gueret
(Continued)

FOREIGN PATENT DOCUMENTS

EP 1236419 A1 9/2002
EP 1938709 A1 7/2008
(Continued)

OTHER PUBLICATIONS

Dec. 12, 2014—(FR) Search Report—App No. FR145505.

*Primary Examiner* — David Walczak
*Assistant Examiner* — Joshua Wiljanen
(74) *Attorney, Agent, or Firm* — Banner & Witcoff, Ltd.

(57) ABSTRACT

An applicator for a cosmetic product, in particular mascara, comprises a twisted core and fibres which extend from the core and are retained by the core, the core extending in a main longitudinal direction, referred to as the main axis (X), the core being rectilinear along the main axis (X), and the fibres forming an envelope (E) with their free ends. The envelope (E) has four faces (F1-F4), the faces (F1-F4) each having a plane of symmetry comprising the main axis (X), each of the four faces (F1-F4) being generated by a straight line, referred to as a generating line, orthogonal to the main axis (X) and orthogonal to the plane of symmetry of the face (F1-F4), at least two consecutive faces (F1, F2) of the four faces (F1-F4) having a curved profile along the main axis (X).

6 Claims, 4 Drawing Sheets

(51) Int. Cl.
*A46B 3/18* (2006.01)
*A46D 3/05* (2006.01)
*A46D 1/04* (2006.01)

(52) U.S. Cl.
CPC ..... *A46D 1/04* (2013.01); *A46D 3/05* (2013.01); *A46B 2200/1053* (2013.01)

(58) Field of Classification Search
USPC ..... 15/206, 207; 132/218, 317
See application file for complete search history.

(56) References Cited

U.S. PATENT DOCUMENTS

| | | | |
|---|---|---|---|
| 2008/0184512 | A1 | 8/2008 | Gueret |
| 2011/0129286 | A1 | 6/2011 | Gueret |

FOREIGN PATENT DOCUMENTS

| | | | | | |
|---|---|---|---|---|---|
| FR | 2811525 | A1 | | 1/2002 | |
| FR | 2973667 | A1 | | 10/2012 | |
| FR | 2973991 | A1 | | 10/2012 | |
| FR | WO 2012140572 | A1 | * | 10/2012 | ..... A45D 40/262 |
| FR | 2991560 | A1 | | 12/2013 | |
| WO | 2009153761 | A2 | | 12/2009 | |

* cited by examiner

APPLICATOR FOR A COSMETIC PRODUCT, IN PARTICULAR MASCARA, AND METHOD OF MANUFACTURING SUCH AN APPLICATOR

CROSS-REFERENCE TO RELATED APPLICATIONS

This application claims priority to French Application Serial No. 1452505, filed Mar. 25, 2014, which is hereby incorporated by reference in its entirety.

FIELD OF INVENTION

The invention relates to an applicator for a cosmetic product, in particular mascara. The invention also relates to a method for manufacturing such an applicator.

BACKGROUND

Mascara applicators can be injection moulded from plastics material, and then they are commonly referred to as "plastic brushes". They can also be obtained from fibrous elements retained between the longitudinal parts of a twisted metal clip; they are then commonly referred to as "twisted brushes". Applicators for mascara have a core, or central part, and bristles extending radially around said core. The ends of said bristles usually form envelopes extending in a longitudinal direction of said brush. The bristles of twisted brushes are commonly referred to as "the fibres".

The plastic brushes according to the prior art have distributions of bristles around the core which make it possible to create complex envelopes which favour the application of make-up. With regard to the twisted brushes, such characteristics appear more difficult to obtain, without employing operations of cutting the fibres in directions which are difficult to implement.

SUMMARY

The invention proposes to produce a twisted brush which exhibits an optimum balance between the difficulty of manufacture and the make-up effects obtained.

Thus the invention relates to an applicator for a cosmetic product, in particular mascara, comprising a twisted core and fibres which extend from the core and are retained by the core, said core extending in a main longitudinal direction, referred to as the main axis, said core being rectilinear along said main axis, and said fibres forming an envelope with their free ends.

According to the invention, the envelope has four faces, said faces each having a plane of symmetry comprising the main axis, each of said four faces being generated by a straight line, referred to as a generating line, orthogonal to the main axis and orthogonal to the plane of symmetry of said face, at least two consecutive faces of said four faces having a curved profile along said main axis.

Thus the invention proposes an applicator having a rectilinear twisted core which has four profiled faces. The limited number of faces to be profiled makes it possible to propose an applicator which is relatively easy to manufacture. Furthermore, profiling said faces along a rectilinear core whilst retaining faces generated by a straight line also facilitates the manufacture due to the manipulations which this allows.

On the other hand, it has been noted that the specific number of four faces provides advantageous make-up effects in terms of thickening lashes, lengthening lashes, curling lashes and/or separating lashes; all the more so since at least two of the four faces of the applicator according to the invention have a curved profile which actively contributes to said advantages, in particular with respect to a brush with rotational symmetry. Moreover, providing a greater number of faces does not improve or even impair the effects obtained, principally because the user no longer perceives, or rather no longer intuitively understands the make-up application function or functions of each of the faces.

The use of an applicator with a twisted core also allows a greater density of fibres than with the bristles of plastic brushes.

According to different embodiments of the invention, which could be considered together or separately:

- at least two consecutive faces of said four faces have a curved profile along said main axis and at least one of said four faces has a substantially convex curved profile along said main axis,
- the core has a distal end and a proximal end, the proximal end being opposite the distal end along the main axis,
- said fibres are distributed along the core, over a substantial part along the length thereof from the distal end and substantially to the proximal end,
- said core consists of a twisted stem,
- said proximal end of the core is extended by a portion of the stem which is devoid of fibres,
- the four faces are symmetrical, two by two, with respect to the main axis,
- a pair of said symmetrical faces has a substantially concave profile along the main axis, in particular from the distal end to the proximal end of the core,
- a pair of said symmetrical faces has a substantially convex profile along the main axis, in particular from the distal end to the proximal end of the core,
- said four faces have a substantially concave profile along the main axis, in particular from the distal end to the proximal end of the core,
- the core has a level situated between its distal and proximal ends, referred to as an intermediate level, in particular substantially equidistant from said distal and proximal ends,
- the envelope includes two pairs of faces which are symmetrical with respect to said main axis, a first pair of faces having a concave undulation of the distal end to said intermediate level and a convex undulation from said intermediate level to the proximal end and a second pair of faces having a convex undulation from the distal end to said intermediate level and a concave undulation from said intermediate level to the proximal end,
- one and only one of said four faces has a substantially concave profile along the main axis, in particular from the distal end to the proximal end of the core,
- two faces which are opposed with respect to the main axis have one and the same S-shaped undulating profile, in particular from the distal end to the proximal end of the core,
- the four faces have one and the same S-shaped undulating profile, in particular from the distal end to the proximal end of the core,
- a section of said envelope formed transversely with respect to the main axis, referred to as a cross section, has substantially the shape of a rectangle,
- said envelope has a chamfer in the region of at least one of its faces, at the distal end of said core,
- the applicator forms a brush.

The invention also relates to a method for manufacturing an applicator for a cosmetic product, in particular mascara, said method comprising:

a step of positioning a plurality of fibres between longitudinal parts of a clip, then a first step of twisting said clip in order to form a twisted clip having fibres extending radially around it, the ends of said fibres forming a cylindrical envelope extending in a longitudinal direction around said clip, then a step of cutting fibres in such a way that said fibres form an envelope with their free ends, said envelope including four faces, said faces each having a plane of symmetry comprising the main axis, each of said four faces being generated by a straight line, referred to as a generating line, orthogonal to the main axis and orthogonal to the plane of symmetry of said face, at least two consecutive faces of said four faces having a curved profile along said main axis and forming, in particular, an envelope such as that described above.

The applicator thus manufactured has the advantage that it includes a distribution of the fibres of which the ends form a complex envelope around its core, using operations which remain simple to implement by a step of cutting.

According to different embodiments of the invention, which could be considered together or separately:

said twisted clip is kept rectilinear, said method comprises a second step of twisting said clip after said step of cutting the fibres, said cutting is digitally controlled.

The invention relates to a receptacle for a cosmetic product, in particular mascara, capable of containing an applicator as described above.

The invention will be better understood, and the other objects, details, features and advantages thereof will become more clearly apparent in the course of the following detailed explanatory description of at least one embodiment of the invention given by way of a purely illustrative and non-limiting example, with reference to the accompanying schematic drawings.

DETAILED DESCRIPTION

Figure 1:
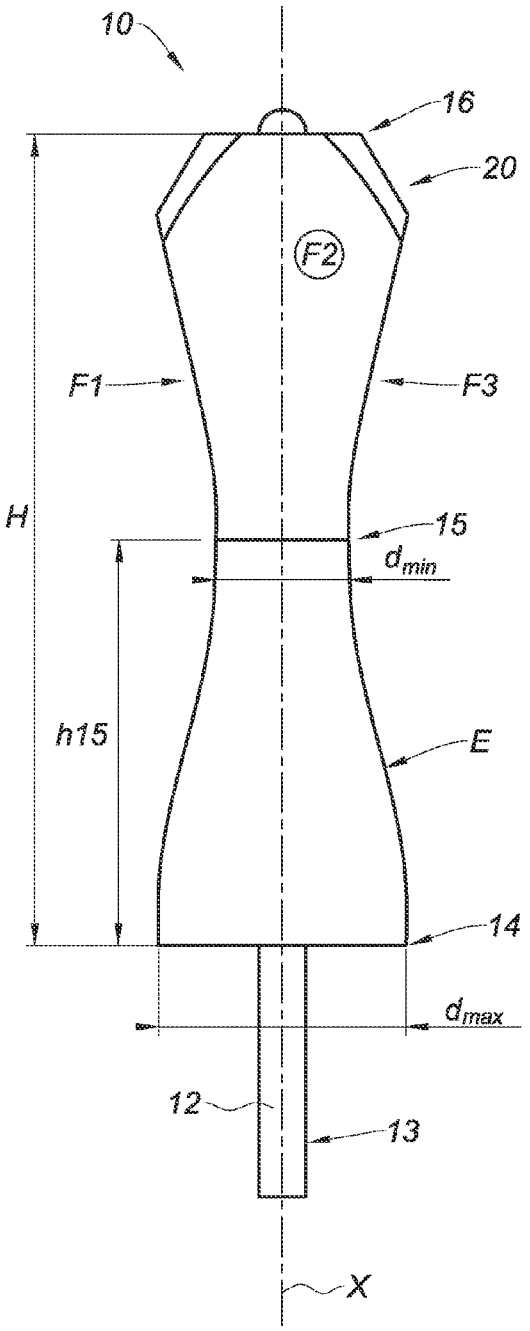
FIG. 1 is a front view of a first embodiment of an applicator according to the invention.

The invention relates to an applicator 10 for a cosmetic product, in particular mascara, comprising a twisted core 12 and fibres which extend from the core 12 and are retained by said core 12.

The core 12 is formed in this case by a metal stem, or clip, having two branches, or longitudinal parts, optionally connected to one another by a curved part. Said metal stem is, for example, folded in two in such a way as to form a "U", the branches of the U then being twisted together.

The fibres extend from the base of the core 12, between a distal end 16 and a proximal end 14 of the core 12. The fibres each have a free end and form an envelope E therewith. FIG. 1 to 8 show, in particular, four examples of configurations of the envelope E according to the invention. The impression of an envelope will of course be more or less pronounced as a function of the density of the fibres.

The applicator 10 extends in a main longitudinal direction, or main axis, which is referenced X in FIG. 1 to 8. This axis X is also advantageously the axis of the core 12. The core 12 will therefore advantageously be a straight line.

The fibres extend transversely, in particular radially, from the core 12, in order to form the envelope E with their free ends, between the distal end 16 and the proximal end 14 of the core 12. These ends 14, 16 are opposed with respect to the axis X and are spaced apart, along said axis X, by a distance referenced H in FIGS. 1, 3, 5 and 7. The distance H is, for example, between 22 mm and 30 mm, and substantially equal, for example, to 22.5 mm or to 26 mm, or even to 27 mm. It should be noted that the proximal end 14 is extended here by a part of the stem which is devoid of fibres.

According to the invention, the envelope E has four faces F1-F4, said faces F1-F4 each having a plane of symmetry comprising the main axis X. Moreover, said faces F1-F4 are advantageously generated by a straight line, referred to as a generating line, orthogonal to the core 12 and orthogonal to the plane of symmetry of each of said faces F1-F4. Thus the envelope has a cross section in a plane substantially orthogonal to said axis X, the shape of which is a polygon, all along said core 12, from said distal end 16 to said proximal end 14, said shape being, in particular, a quadrilateral, or even a rectangle, in particular in the region of an intermediate line 15. At least two consecutive faces of said four faces F1-F4 have a curved profile along said main axis X.

In the embodiments shown here, the four faces F1-F4 have a curved profile along said main axis X.

Figure 2:
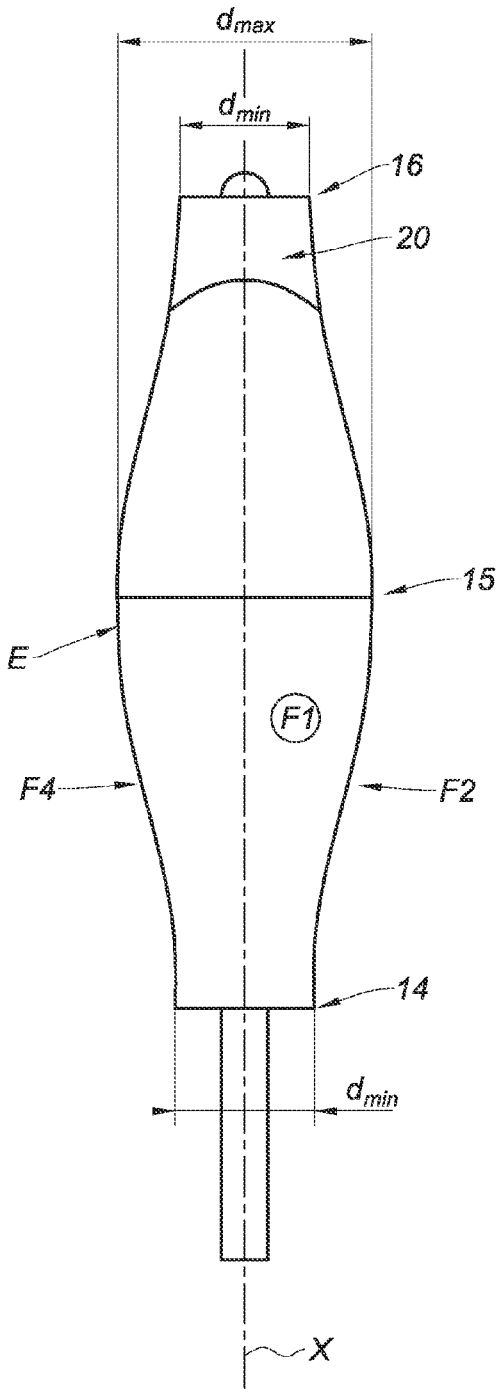
FIG. 2 shows the applicator of FIG. 1 after said applicator has been turned by a quarter turn around its longitudinal axis.
Figure 3:
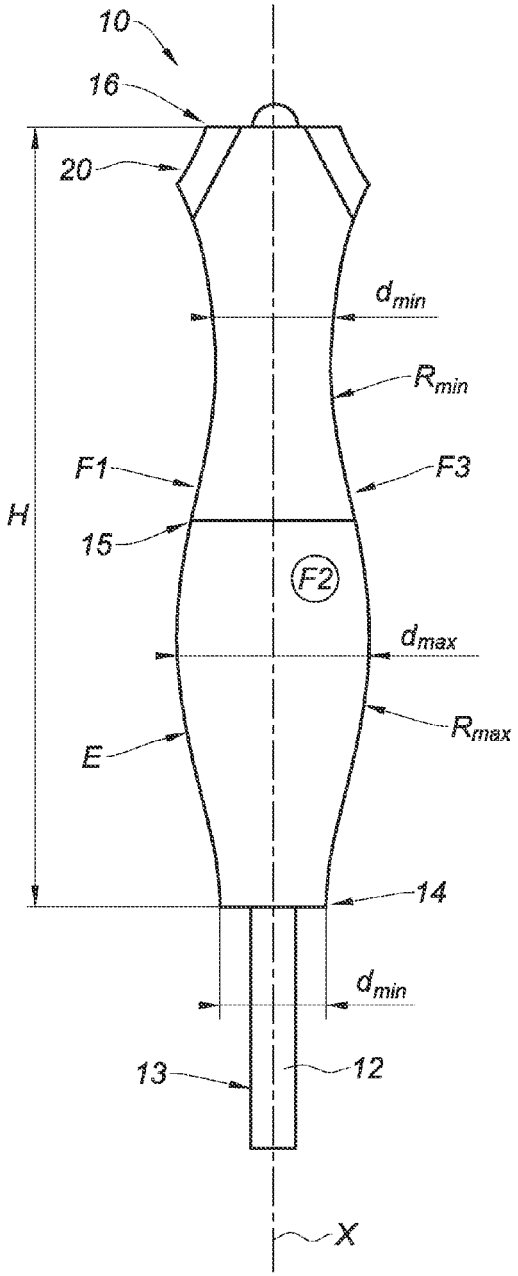
FIG. 3 is a front view of a second embodiment of an applicator according to the invention.
Figure 4:
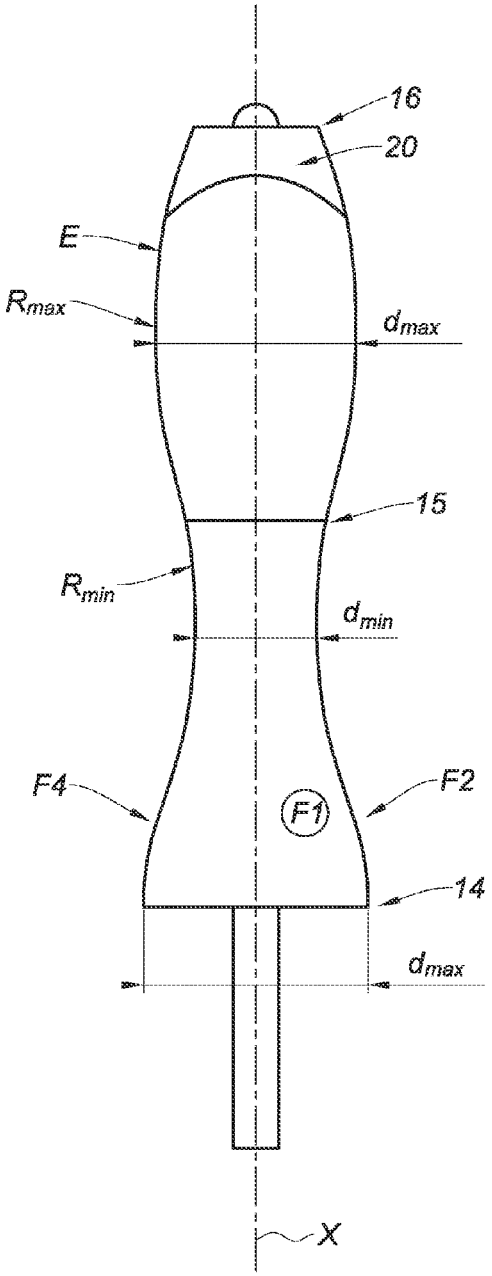
FIG. 4 shows the applicator of FIG. 3 after said applicator has been turned by a quarter turn around its longitudinal axis.

In the embodiment shown in FIGS. 1 and 2 as well as in the embodiment shown in FIGS. 3 and 4, the envelope E has curved faces F1-F4 with variable slopes or inclinations and which change direction from one face F1, F3 to the other F2, F4. In addition to these changes of direction from one face to the other, the alternation of slopes, or inclinations, takes place from the distal end 16 to the proximal end 14. The envelope E may therefore have depressions alternating with reliefs around said core 12, that is to say turning around said core in a plane orthogonal to said core and, advantageously, all along the core 12, from its distal end 16 to its proximal end 14.

Thus, in FIG. 1, the depressions are situated in the vicinity of the intermediate line 15 situated between the distal end 16 and the proximal end 14. Said intermediate line 15 belongs to a plane substantially orthogonal to the axis X which comprises an intermediate point of the axis X, said point being advantageously equidistant to said ends 14, 16. The distance h15 separating the proximal end 14 of this intermediate line 15 following said axis X is substantially equal, for example, to 13 mm. This intermediate line 15 is an imaginary line which follows the perimeter of the envelope E.

By contrast, when the applicator 10 is observed from the side, as shown in FIG. 2, the depressions are close to the distal and proximal ends 14, 16 and the reliefs are close to the intermediate line 15.

The envelope E of the embodiment shown in FIGS. 1 and 2 therefore includes a pair of curved faces F2, F4 which are substantially convex from the distal end 16 to the proximal end 14 of the core 12. In other words, in the context of this embodiment at least one of the four faces F1-F4 has a curved profile which is substantially convex along said main axis X.

It should be noted that FIG. 1 shows the face F2 by its contours, in one plane (that of the page); however, the curvature in space of said face F2 is visible in FIG. 2 where it is represented in profile.

The envelope E of the embodiment shown in FIGS. 1 and 2 also includes a pair of curved faces F1, F3 which are substantially concave from the distal end 16 to the proximal end 14 of the core 12 (shown in FIG. 2 but of which the curvature in space is visible in FIG. 1).

In the embodiment shown in FIG. 3, the depressions are situated between the distal end 16 and the intermediate line 15 and also in the vicinity of the proximal end 14, whereas the reliefs are situated in the vicinity of the proximal end 16 and also between the intermediate line 15 and the proximal end 14.

By contrast, when the applicator 10 is observed from the side, as shown in FIG. 4, the depressions are situated in the vicinity of the distal end 16 and also between the intermediate line 15 and the proximal end 14, whereas the reliefs are situated between the distal end 16 and the intermediate line 15 and also in the vicinity of the proximal end 14.

The envelope E of the embodiment of FIGS. 3 and 4 therefore includes a pair of curved faces F1, F3 which have a concave undulation from the distal end 16 to said intermediate line 15 and a convex undulation from said intermediate line 15 to the proximal end 14; the contour of these faces F1, F3 is shown in FIG. 4, but their curvature in space is only visible in FIG. 3, said faces F1, F3 being seen in profile there.

The envelope E of the embodiment of FIGS. 3 and 4 also includes a pair of curved faces F2, F4 which have a convex undulation from the distal end 16 to said intermediate line 15 and a concave undulation from said intermediate line 15 to the proximal end 14; the contour of these faces F2, F4 is shown in FIG. 3, their curvature in space being visible in FIG. 4.

In other words, in the context of this embodiment at least one of the four faces F1-F4 has a curved profile which is substantially convex along said main axis X.

By way of example, the concave curvatures mentioned above will advantageously have a radius of curvature, referenced Rmin in FIGS. 3 and 4, which is between 15 and 20 mm and which is substantially equal to 17 mm. Likewise, the convex curvatures mentioned above will advantageously have a radius of curvature Rmax which is between 17.5 and 22.5 mm and which is substantially equal to 20 mm.

The envelopes E of the two embodiments which have just been described each include two pairs of faces F1, F3 and F2, F4 which are symmetrical, two by two, with respect to a median plane comprising the core 12.

Each face belonging to a said pair is opposite the other face of said pair with respect to the core of the brush, even symmetrical with respect to a median plane passing through the core, and the two faces of one and the same pair will have the same slopes, or inclinations, except for the sign, the slopes or inclinations changing direction from one pair of faces to the other. More precisely, said slopes, or inclinations, reverse direction from one pair of faces to the other.

Thus, when the applicator 10 according to the invention, in the two embodiments which have just been described, is viewed from the front, and then the observer makes it turn around the axis of symmetry X of its core 12, he sees alternating faces F1-F4 with slopes which change and, more particularly, faces with slopes which reverse, in an alternating manner and all along the axis X.

This alternation of slopes around and along the core 12 makes it possible advantageously to cause combing surfaces and coating surfaces to alternate around and along the applicator 10.

Figure 5:
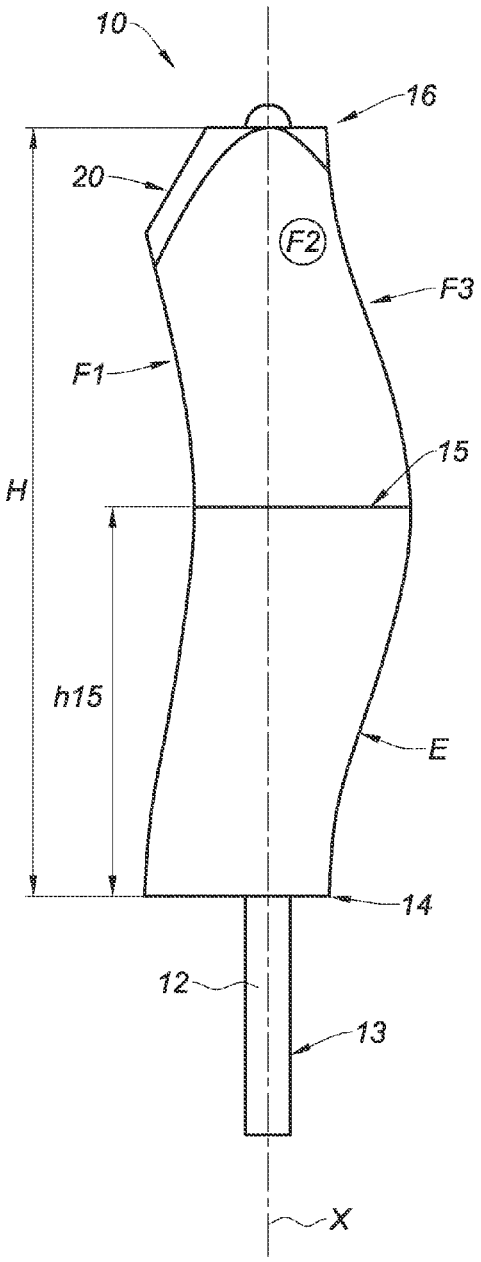
FIG. 5 is a front view of a third embodiment of an applicator according to the invention.
Figure 6:
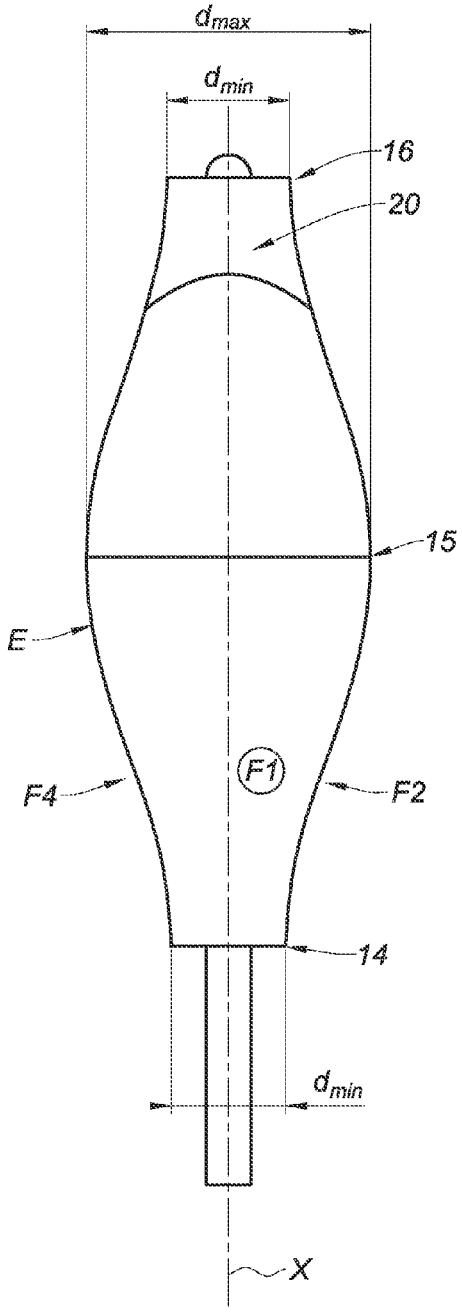
FIG. 6 shows the applicator of FIG. 5 after said applicator has been turned by a quarter turn around its longitudinal axis.

In the embodiment shown in FIGS. 5 and 6, the envelope E comprises, along said main axis X, a substantially concave face F1 and an opposing substantially convex face F3. In other words, in the context of this embodiment at least one of the four faces F1-F4 has a curved profile which is substantially convex along said main axis X.

The concave face is referenced F1 in FIG. 5. This concave face F1 has an extremum in the vicinity of the intermediate line 15.

In FIG. 5 the convex face, opposite the concave face F1, is referenced F3. This convex face F3 has an extremum in the vicinity of the intermediate line 15. The opposing face is understood to be the face F3 which is located opposite the concave face F1 with respect to the core 12. In other words, the opposing faces F1, F3 are not in contact.

FIG. 6 shows the applicator 10 when it is observed from the side with respect to FIG. 5. It is possible to observe there the shape of two faces F2, F4 which are the faces connecting said two concave and convex faces F1, F3 which have just been described. These faces F2, F4 will be referred to as connecting faces hereinafter. These two connecting faces F2, F4 are substantially convex here. Said two connecting faces F2, F4 have, in particular, an extremum in the vicinity of the intermediate line 15.

It should be noted that FIG. 5 shows the face F2 by its contours, in one plane (that of the page); however, the curvature in space of said face F2 is visible in FIG. 2 because it is represented in profile there.

Likewise, the concave face F1, shown in FIG. 2 by its contours, has a curvature in space which is visible in FIG. 1.

The envelope E of the embodiment which has just been described with reference to FIGS. 5 and 6 includes two pairs of faces F1, F3, and F2, F4. One of the pairs of faces includes faces F2, F4 which are symmetrical with respect to a median plane comprising the core 12; these are the faces referred to as the connecting faces F2, F4. The other pair of faces F1, F3 follows substantially the same curve along the main axis X (see FIG. 5). This envelope E has the advantage of curving and of coating the user's lashes in an optimal manner since it has a concave face formed by fibres with short radial extensions which have a substantial coating capability.

Figure 7:
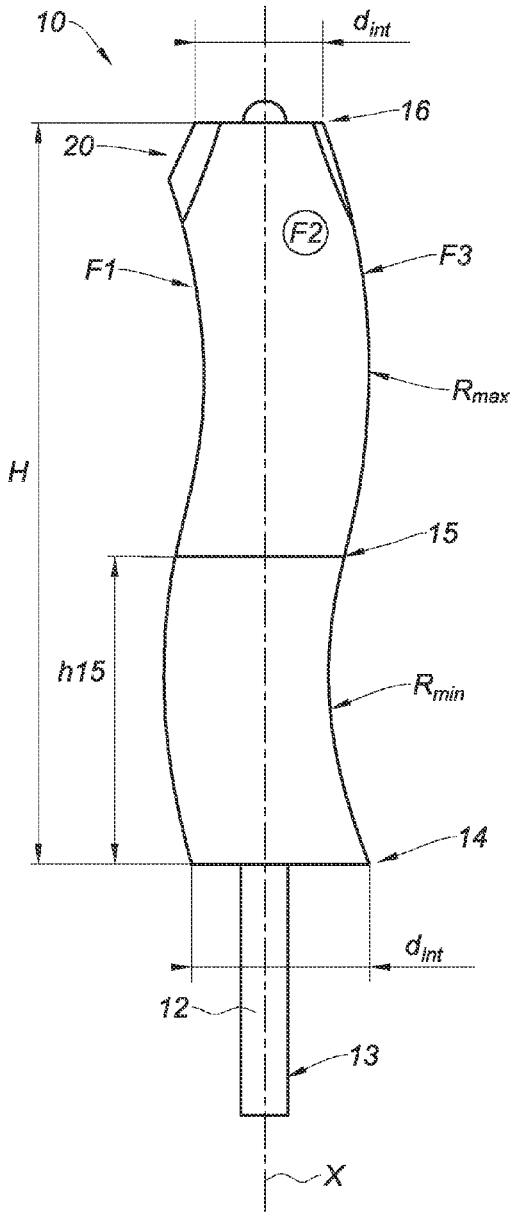
FIG. 7 is a front view of a fourth embodiment of an applicator according to the invention.
Figure 8:
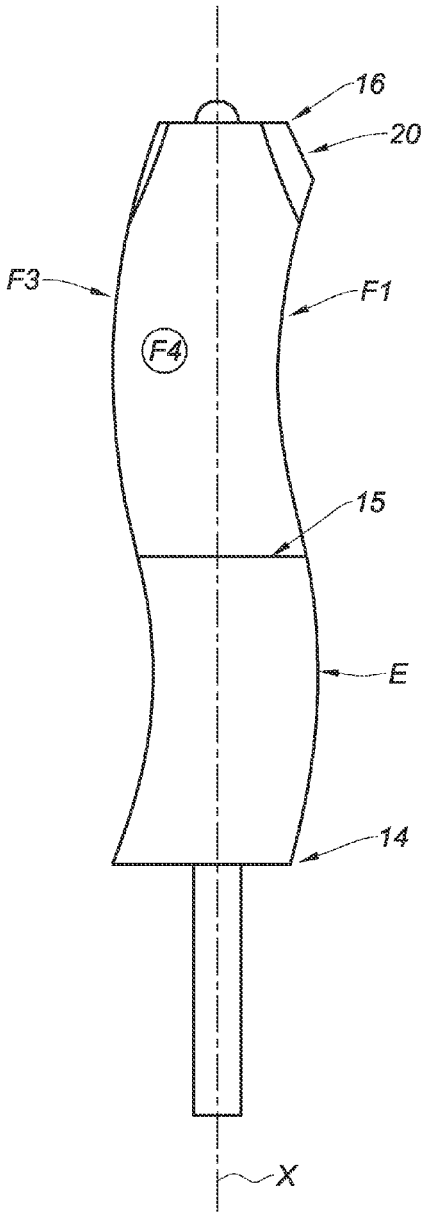
FIG. 8 shows the applicator of FIG. 7 after said applicator has been turned by a half turn around its longitudinal axis.

In the fourth embodiment which is shown in FIGS. 7 and 8, the envelope E comprises, along said main axis X, curved faces which are opposed, two by two, with respect to the main axis X, which have one and the same S-shaped undulating profile, in particular from the distal end 16 to the proximal end 14 of the core 12. In other words, the envelope E of the embodiment of FIGS. 7 and 8 includes a pair of curved faces F1, F3 which have an S-shaped undulation along the principal axis X which, when the applicator according to the invention is viewed from the front—the observer looking at the face F2—has the following shapes: for F1, a concave shape from the distal end 16 to the intermediate line 15 and a convex shape from the intermediate line 15 to the proximal end 14, and for F3, a convex shape from the distal end 16 to the intermediate line 15 and a concave shape from the intermediate line 15 to the proximal end 14 (see FIG. 7). In other words, in the context of this embodiment at least one of the four faces F1-F4 has a curved profile which is substantially convex along said main axis X.

As in the context of the example shown in FIGS. 3 and 4, the concave curvatures mentioned above will advantageously have a radius of curvature, referenced Rmin, which is between 15 and 20 mm and which is substantially equal to 17 mm. Likewise, the convex curvatures mentioned above will advantageously have a radius of curvature Rmax which is between 17.5 and 22.5 mm and which is substantially equal to 20 mm.

The profile of the envelope E which has just been described—fourth embodiment—has advantageous possibilities for applying make-up. In fact, it makes it possible to apply make-up to a line of lashes according to the intensities which differ for the lashes of which it is composed.

The applicator according to the invention has faces F1-F4 delimited by separate lateral edges. In other words, the faces F1-F4 are delimited by ridges—the lateral edges—which are parameterised curves in a Cartesian coordinate system orthonormal with respect to three dimensions, wherein one of said dimensions coincides with the direction of said axis X, the coordinates of said parameterised curves evolve in the three directions of said Cartesian coordinate system and said parameterised curves do not coincide at any point between said distal end 16 and said proximal end 14.

Said ridges therefore have a track which is complex albeit obtained with faces which remain easy to produce. This track is particularly advantageous in order to engage the lashes and to lengthen them.

In order to facilitate the return of the brush 10 into its receptacle, the envelope of the applicator 10 can have chamfers 20 in the region of some of its faces, at the distal end 16 of the core 12. In fact, the distal end 16 is usually the end by which the contact with the receptacle is made when the user puts away the applicator 10 after use. The envelope preferably comprises at least two opposing faces F1, F3, with chamfers 20 which are symmetrical with respect to a median plane passing through said core 12. The height of these chamfers 20 will be between 0 (absence of chamfers) and 5 mm.

It is useful to note that the width of the envelope E is functionally linked to the advantages of the applicator 10; said width varies along the axis X, between extremes, said extremes being referenced dmax, dint and dmin in FIG. 1 to 7. Moreover, dmax, dmin correspond to the space required for the envelope in the vicinity of the tops of the reliefs for dmax and the depressions for dmin. The following formula will advantageously apply:

$0.125 \leq dmin/dmax \leq 0.625$. For example, dmax will be between 6 and 8 mm and dmin will be between 3 and 4.5 mm.

dint corresponds to the space required for the envelope E in the particular case of the fourth embodiment. For example, dint will be between 4.5 and 6.5 mm (see FIG. 7).

The invention also relates to a method for manufacturing an applicator for a cosmetic product, in particular mascara, for example the applicator which has just been described.

This method comprises first of all a step of positioning a plurality of fibres between longitudinal parts of a clip (not shown). The fibres are distributed in such a way that said longitudinal parts run substantially in the middle of each of said fibres.

The next step of said method is a first step of twisting said clip in order to form a twisted clip having fibres extending radially around it. The ends of said fibres then form a cylindrical envelope extending in a longitudinal direction around said clip. The fibres are distributed in the shape of spirals of fibres due to the twisting of the clip.

The step which follows is a step of cutting fibres in such a way that said fibres form an envelope E with their free ends, said envelope E including four faces F1-F4, said faces F1-F4 each having a plane of symmetry comprising the main axis 12, each of said four faces F1-F4 being generated by a straight line, referred to as a generating line, orthogonal to the main axis X and orthogonal to the plane of symmetry of said face, at least two consecutive faces of said four faces F1-F4 having a curved profile along said main axis X and forming, in particular, an envelope E such as that described above. Said cutting could be digitally controlled. During all these operations, said twisted clip is kept rectilinear.

Advantageously, the part of the clip devoid of fibres which lengthens the proximal end 14 will be intended to be fixed inside a hollow stem which is itself joined to a handle by which the user manipulates said applicator. Said portion is or is not twisted.

It should be noted that the applicator according to the invention advantageously forms a brush.

It should also be noted that the embodiments shown in FIG. 1 to 7 can advantageously be combined in order to pool the make-up effects thereof, or even for the purpose of obtaining new make-up effects.

It should also be noted that variants of the embodiments are of course possible. In particular, it may also be envisaged to provide the envelope E in a helical shape in an embodiment which is not shown here. In other words, the edges of the faces described above could follow a helix from the proximal end 14 to the distal end 16 of the applicator 10, for example due to a second step of twisting as part of the method according to the invention.

We claim:

1. Applicator for a cosmetic product, in particular mascara, comprising a twisted core and fibres which extend from the core and are retained by said core, said core extending in a main longitudinal direction, referred to as the main axis (X), said core being rectilinear along said main axis (X), and said fibres forming an envelope (E) with their free ends, characterised in that the envelope (E) has four faces (F1-F4), said faces (F1-F4) each having a plane of symmetry comprising the main axis (X), each of said four faces (F1-F4) being generated by a straight line, referred to as a generating line, orthogonal to the main axis (X) and orthogonal to the plane of symmetry of said face (F1-F4), at least two consecutive faces (F1, F2) of said four faces (F1-F4) having a curved profile along said main axis (X), wherein the four faces (F1-F4) are symmetrical, two by two, with respect to the main axis (X), wherein a pair of said symmetrical faces (F1, F3) has a substantially concave profile along the main axis (X) and a pair (F2, F4) of said symmetrical faces has a substantially convex profile along the main axis (X).

2. Applicator according to claim 1, wherein a section of said envelope (E) formed transversely with respect to the main axis (X), referred to as a cross section, has substantially the shape of a rectangle.

3. Receptacle for a cosmetic product, in particular mascara, capable of containing an applicator according to claim 1.

4. Applicator for a cosmetic product, in particular mascara, comprising a twisted core and fibres which extend from the core and are retained by said core, said core extending in a main longitudinal direction, referred to as the main axis (X), said core being rectilinear along said main axis (X), and said fibres forming an envelope (E) with their free ends, characterised in that the envelope (E) has four faces (F1-F4), said faces (F1-F4) each having a plane of symmetry comprising the main axis (X), each of said four faces (F1-F4) being generated by a straight line, referred to as a generating line, orthogonal to the main axis (X) and orthogonal to the plane of symmetry of said face (F1-F4), at least two consecutive faces (F1, F2) of said four faces (F1-F4) having a curved profile along said main axis (X) and at least one of said four faces has a substantially convex curved profile along said main axis, wherein one and only one of said four faces (F1) has a substantially concave profile along the main axis (X).

5. Applicator for a cosmetic product, in particular mascara, comprising a twisted core and fibres which extend from the core and are retained by said core, said core extending in a main longitudinal direction, referred to as the main axis (X), said core being rectilinear along said main axis (X), and said fibres forming an envelope (E) with their free ends, characterised in that the envelope (E) has four faces (F1-F4), said faces (F1-F4) each having a plane of symmetry comprising the main axis (X), each of said four faces (F1-F4) being generated by a straight line, referred to as a generating line, orthogonal to the main axis (X) and orthogonal to the plane of symmetry of said face (F1-F4), at least two consecutive faces (F1, F2) of said four faces (F1-F4) having a curved profile along said main axis (X), wherein two faces (F1, F3) which are opposed with respect to the main axis (X) have one and the same S-shaped undulating profile with respect to the main axis (X).

6. Applicator according to claim 5, wherein each of the four faces (F1-F4) has an S-shaped undulating profile.

* * * * *